US008289237B2

(12) United States Patent
Choi et al.

(10) Patent No.: US 8,289,237 B2
(45) Date of Patent: Oct. 16, 2012

(54) PIXEL AND ORGANIC LIGHT EMITTING DISPLAY USING THE SAME

(75) Inventors: Sang-moo Choi, Suwon-si (KR); Wang-jo Lee, Suwon-si (KR); Bo-yong Chung, Suwon-si (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 754 days.

(21) Appl. No.: 12/004,282

(22) Filed: Dec. 19, 2007

(65) Prior Publication Data

US 2008/0143651 A1 Jun. 19, 2008

(30) Foreign Application Priority Data

Dec. 19, 2006 (KR) ..... 10-2006-0130112

(51) Int. Cl.
*G09G 3/30* (2006.01)

(52) U.S. Cl. ..... 345/76; 345/204; 345/690; 315/169.3

(58) Field of Classification Search ..... 345/76–102, 345/36, 45; 315/169.1, 169.3
See application file for complete search history.

(56) References Cited

U.S. PATENT DOCUMENTS

| | | | | |
|---|---|---|---|---|
| 7,804,466 | B2 * | 9/2010 | Kwak et al. | 345/76 |
| 2002/0118150 | A1 * | 8/2002 | Kwon | 345/76 |
| 2005/0179628 | A1 * | 8/2005 | Kimura | 345/77 |
| 2007/0159432 | A1 * | 7/2007 | Tseng et al. | 345/92 |

FOREIGN PATENT DOCUMENTS

KR 10-2002-0056353 7/2002

* cited by examiner

*Primary Examiner* — Kevin M Nguyen
*Assistant Examiner* — Kenneth B Lee, Jr.
(74) *Attorney, Agent, or Firm* — Knobbe Martens Olson & Bear, LLP

(57) ABSTRACT

A pixel of a simplified configuration, and an organic light emitting display using the same are disclosed. The pixel includes an organic light emitting diode; a first transistor connected with a scan line and a data line and turned on when a scan signal is supplied to the scan lines; a storage capacitor having one terminal connected to an electrode of the first transistor and the other terminal connected to a reset line; and a second transistor for controlling an electric current that flows from a first power source to a second power source through the organic light emitting diode according to a voltage charged in the storage capacitor, wherein the second transistor is turned-off when a reset signal is supplied to the reset line.

22 Claims, 6 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2006-0130112, filed on Dec. 19, 2006, in the Korean Intellectual Property Office, the entire content of which is incorporated herein by reference.

BACKGROUND

1. Field

The field relates to a pixel and an organic light emitting display using the same, and more specifically to a pixel for simplifying a configuration, and an organic light emitting display using the same.

2. Description of the Related Technology

In recent years, there have been may attempts to develop various flat panel displays with reduced weight and volume compared with a cathode ray tube, which are problematic in the cathode ray tube. Flat panel displays includes a liquid crystal display, a field emission display, a plasma display panel, an organic light emitting display, etc.

Amongst flat panel display devices, the organic light emitting display displays an image using an organic light emitting diode which generates light by means of recombination of electrons and holes. Such an organic light emitting display has an advantage that it has a rapid response time and may be also driven with a low consumption power.

FIG. 1 is a circuit view showing a pixel 4 of a conventional organic light emitting display.

Referring to FIG. 1, the pixel 4 of the conventional organic light emitting display includes an organic light emitting diode (OLED), and a pixel circuit 2 connected to a data line (Dm) and a scan line (Sn) to control the organic light emitting diode (OLED).

An anode electrode of the organic light emitting diode (OLED) is connected to the pixel circuit 2, and a cathode electrode is connected to a second power source (ELVSS). Such an organic light emitting diode (OLED) generates the light having a luminance corresponding to an electric current supplied to the organic light emitting diode (OLED) by the pixel circuit 2.

The pixel circuit 2 controls current supplied to the organic light emitting diode (OLED) to correspond to a data signal supplied to the data line (Dm) when a scan signal is supplied to the scan line (Sn). For this purpose, the pixel circuit 2 includes a second transistor (M2) and a third transistor (M3) connected between a first power source (ELVDD) and the organic light emitting diode (OLED); a first transistor (M1) connected to the second transistor (M2), the data line (Dm) and the scan line (Sn); and a storage capacitor (Cst) connected between a gate electrode and a first electrode of the second transistor (M2).

The gate electrode of the first transistor (M1) is connected to the scan line (Sn), and the first electrode is connected to the data line (Dm). And, the second electrode of the first transistor (M1) is connected to one side terminal of the storage capacitor (Cst). Here, the first electrode is one of a source electrode and a drain electrode, and the second electrode is an electrode different to the first electrode. For example, a second electrode is a drain electrode if the first electrode is a source electrode. The first transistor (M1) connected to the scan line (Sn) and the data line (Dm) is turned on when a scan signal is supplied to the scan line (Sn), thereby supplying a data signal, supplied on the data line (Dm), to the storage capacitor (Cst). The storage capacitor (Cst) then stores a voltage corresponding to the data signal.

The gate electrode of the second transistor (M2) is connected to one side terminal of the storage capacitor (Cst), and the first electrode is connected to the other side terminal of the storage capacitor (Cst) and the first power source (ELVDD). And the second electrode of the second transistor (M2) is connected to the anode electrode of the organic light emitting diode (OLED). Such a second transistor (M2) controls a current to correspond to a voltage value stored in the storage capacitor (Cst), wherein the controlled current flows from the first power source (ELVDD) through the organic light emitting diode (OLED) to the second power source (ELVSS). In response, the organic light emitting diode (OLED) generates light corresponding to the current flowing therethrough.

A first electrode of the third transistor (M3) is connected to the second electrode of the second transistor (M2), and a second electrode is connected to the anode electrode of the organic light emitting diode (OLED). And a gate electrode of the third transistor (M3) is connected to the light emitting control lines (En). The third transistor (M3) controls timing of the electric current to the organic light emitting diode (OLED) according to a light emitting control signal supplied to the light emitting control lines (En).

The conventional organic light emitting display is driven in an analog driving mode. In other words, a voltage stored in the storage capacitor (Cst) may be used to display various grey levels. However, it is difficult to display an image having a uniform luminance in a panel due to the variation in a threshold voltage of the second transistor (M2) (a drive transistor) if the voltage stored in the storage capacitor (Cst) is used to display various grey levels. Also, the pixel as shown in FIG. 1 has a problem that it further includes a transistor (M3) for controlling supply time of the electric current supplied to the organic light emitting diode (OLED).

SUMMARY OF THE CERTAIN INVENTIVE ASPECTS

One aspect is a pixel circuit, including an organic light emitting diode, and a first transistor connected with a scan line and a data line, the first transistor configured to be turned on when a scan signal is supplied to the scan line. The circuit also includes a storage capacitor having one terminal connected to an electrode of the first transistor and the other terminal connected to a reset line, and a second transistor configured to control an electric current flowing from a first power source to a second power source through the organic light emitting diode according to a voltage of the storage capacitor, where the second transistor is turned off when a reset signal is supplied to the reset line.

Another aspect is an organic light emitting display, including a scan driver configured to sequentially supply a scan signal to a plurality of scan lines during a plurality of subframe periods during one frame and to supply a reset signal to a plurality of reset lines to control the duration of light emission periods of the pixels during the subframe periods, a data driver configured to supply a data signal to a plurality of data lines such that the data signal is synchronized with the scan signal, and pixels configured to emit light or to not emit light according to the data signal, and to be put into a non-light-emitting state when the reset signal is applied. Each of the pixels includes an organic light emitting diode, a first transistor connected with a scan line and a data line, the first transistor configured to be turned on when a scan signal is supplied to the scan line, a storage capacitor having one terminal connected to an electrode of the first transistor and the other terminal connected to a reset line, and a second transistor configured to control an electric current flowing from a first power source to a second power source through the organic light emitting diode according to a voltage of the storage capacitor, where the second transistor is turned off when a reset signal is supplied to the reset line.

Another aspect is an organic light emitting display, including a scan driver configured to sequentially supply a scan signal to a plurality of scan lines during a plurality of subframe periods during one frame and to supply a reset signal to a plurality of reset lines, a data driver configured to apply data signals to a plurality of data lines such that the data signal is synchronized with the scan signal, a plurality of pixels configured to emit red light each connected to the scan lines and the reset lines, a plurality of pixels configured to emit green light each connected to the scan lines and the reset lines, a plurality of pixels configured to emit blue light each connected to the scan lines and the reset lines, where the scan driver is configured to control the duration of light emission periods, and the duration of the emission period for each of the pixels is based on the color of the light emitted by the pixel.

BRIEF DESCRIPTION OF THE DRAWINGS

These and/or other aspects of the invention will become apparent and more readily appreciated from the following description of certain embodiments, taken in conjunction with the accompanying drawings of which.

DETAILED DESCRIPTION OF CERTAIN INVENTIVE EMBODIMENTS

Figure 1:
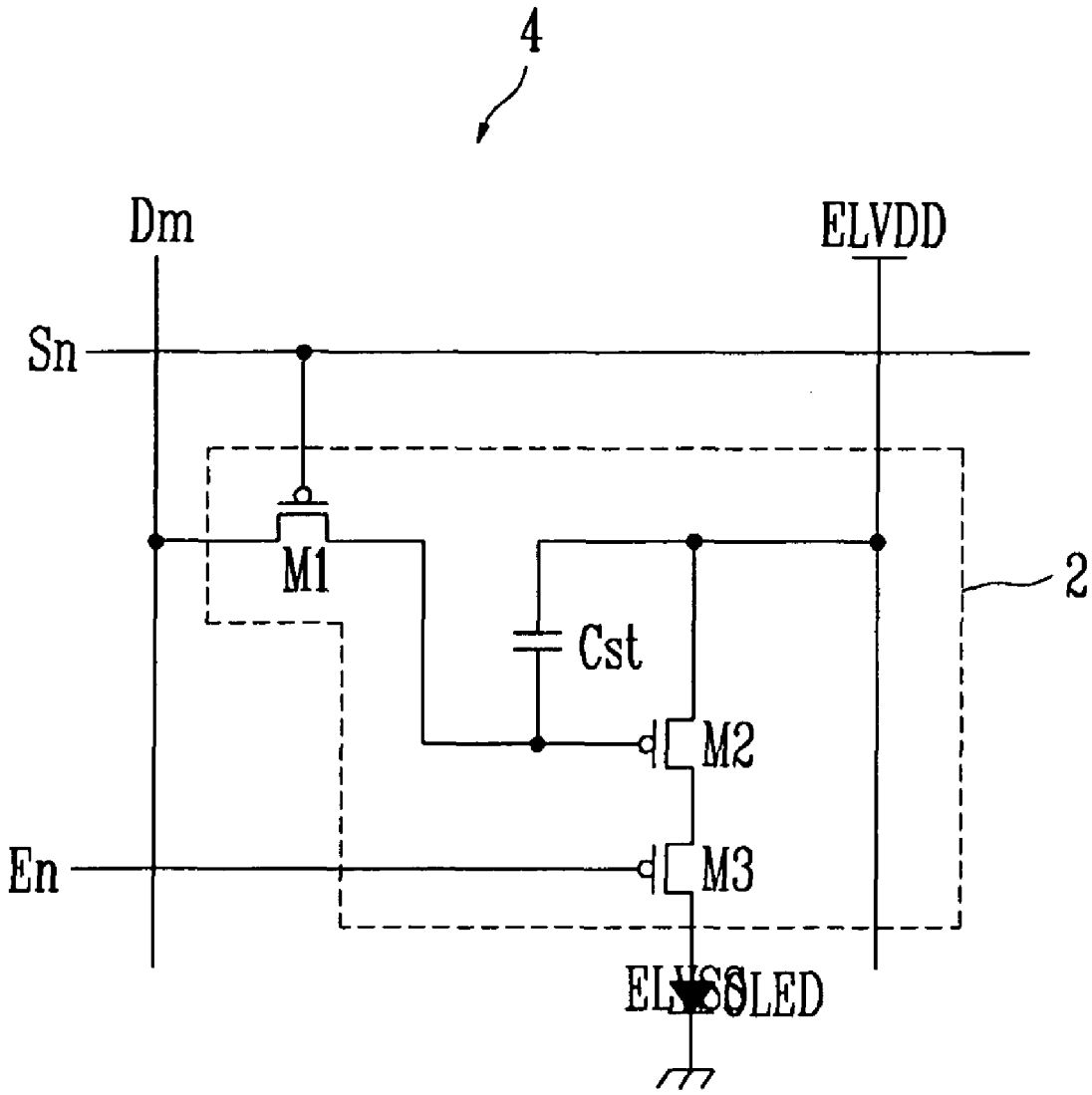
FIG. 1 (PRIOR ART)
FIG. 1 is a circuit view showing certain aspects of a conventional pixel.

Hereinafter, certain embodiments will be described with reference to the accompanying drawings. Here, when a first element is described as being connected to a second element, the first element may be directly connected to the second element or may be indirectly connected to the second element via one or more additional elements. Further, elements that are not essential to the understanding of the invention may be omitted for clarity. Also, like reference numerals refer to like elements throughout.

Figure 2:
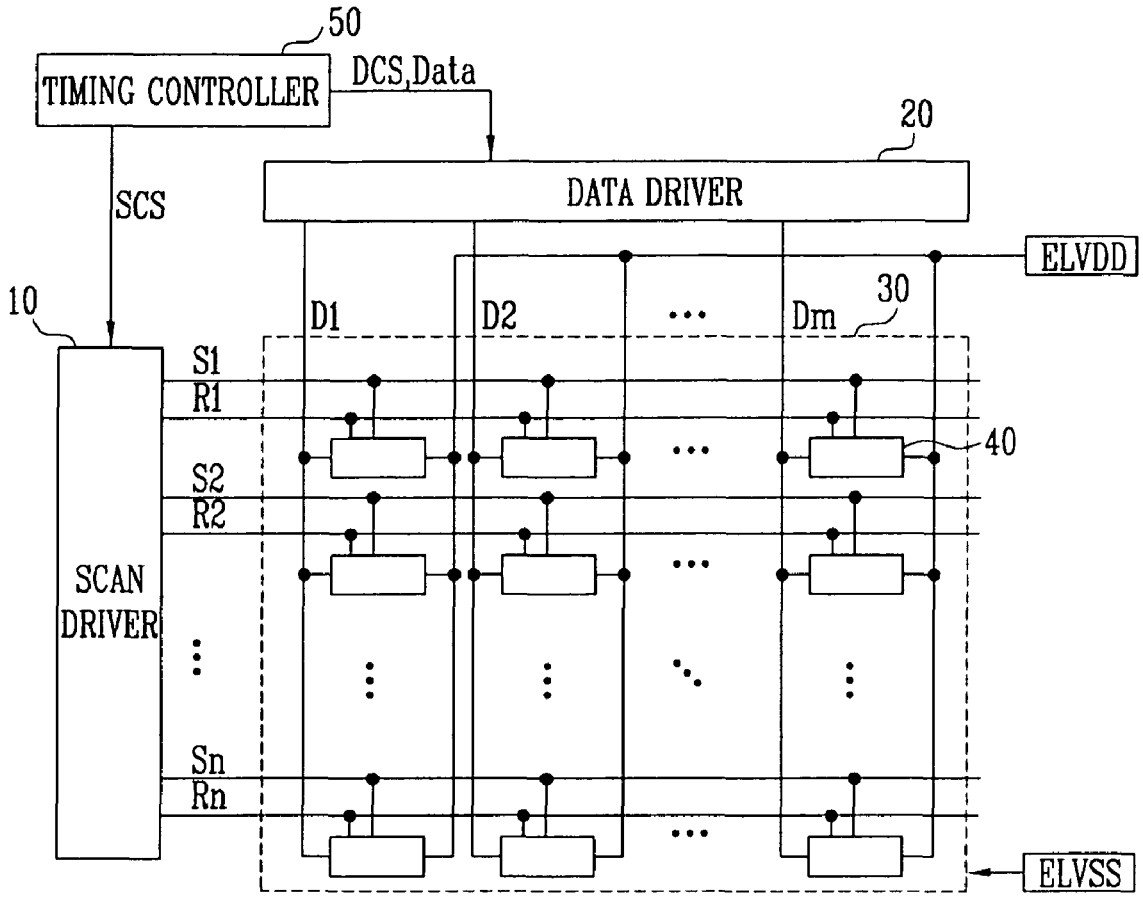
FIG. 2 is a diagram showing an organic light emitting display device according to one embodiment.

FIG. 2 is a diagram showing an organic light emitting display according to one embodiment.

Referring to FIG. 2, the organic light emitting display according to some embodiments includes a pixel unit 30 including a plurality of pixels 40 connected with scan lines (S1 to Sn), reset lines (R1 to Rn) and data lines (D1 to Dm); a scan driver 10 for driving scan lines (S1 to Sn) and reset lines (R1 to Rn); a data driver 20 for driving data lines (D1 to Dm); and a timing controller 50 for controlling a scan driver 10 and a data driver 20.

The timing controller 50 generates a data drive control signal (DCS) and a scan drive control signal (SCS) to correspond to synchronizing signals. The data drive control signal (DCS) generated in the timing controller 50 is supplied to the data driver 20, and the scan drive control signal (SCS) is supplied to the scan driver 10. In addition, the timing controller 50 supplies data to the data driver 20.

The data driver 20 supplies a data signal to the data lines (D1 to Dm) during a plurality of subframe periods in one frame. Here, the data signal is divided into a first data signal for allowing the pixel 40 to emit the light; and a second data signal for allowing the pixel 40 not to emit the light. The data driver 20 supplies the first data signal or the second data signal to the data lines (D1 to Dm) during each of the subframe periods, wherein the first data signal or the second data signal control whether the pixel 40 emits light or does not emit light.

The scan driver 10 sequentially supplies a scan signal to the scan lines (S1 to Sn) during each of the subframe periods. If the scan signal is sequentially supplied to the scan lines (S1 to Sn), the pixels 40 are sequentially selected by line, and the selected pixels 40 receive a first data signal or a second data signal supplied from the data lines (D1 to Dm). And, the scan driver 10 supplies a reset signal to the reset lines (R1 to Rn) so as to control a light emission time of the pixels 40 in each of the subframes. The pixels 40 receiving the reset signal are, as a result, in a non-light-emitted state regardless of the previous state.

The pixel unit 30 receives a first power source (ELVDD) and a second power source (ELVSS) and supplies the first power source (ELVDD) and the second power source (ELVSS) to each of the pixels 40. Each of the pixels 40 receiving the first power source (ELVDD) and the second power source (ELVSS) receives a data signal (a first data signal or a second data signal) when the scan signal is supplied thereto, and either emits light or does not emit light during each of the subframe periods corresponding to the received data signals. In addition, the pixels 40 are in a non-light-emitted state when the reset signal is supplied thereto.

Figure 3:
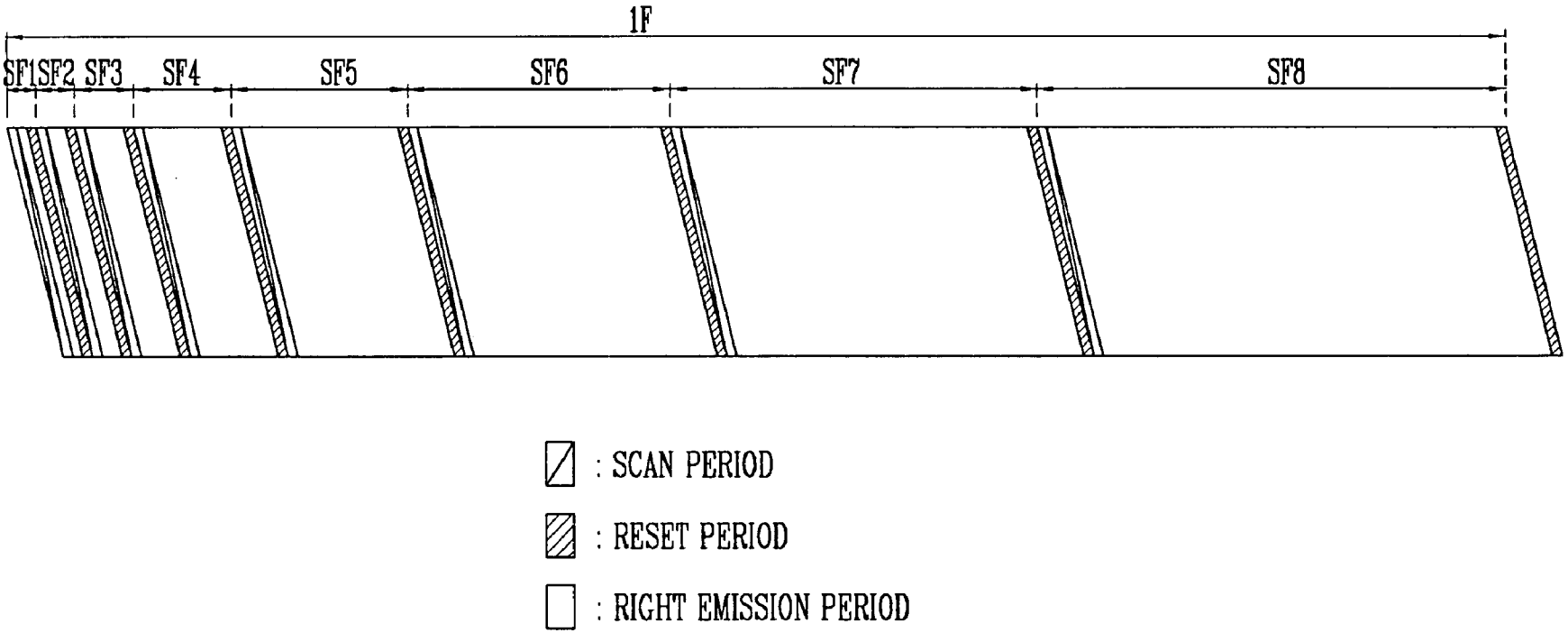
FIG. 3 is a diagram showing one frame according to one embodiment.
Figure 4:
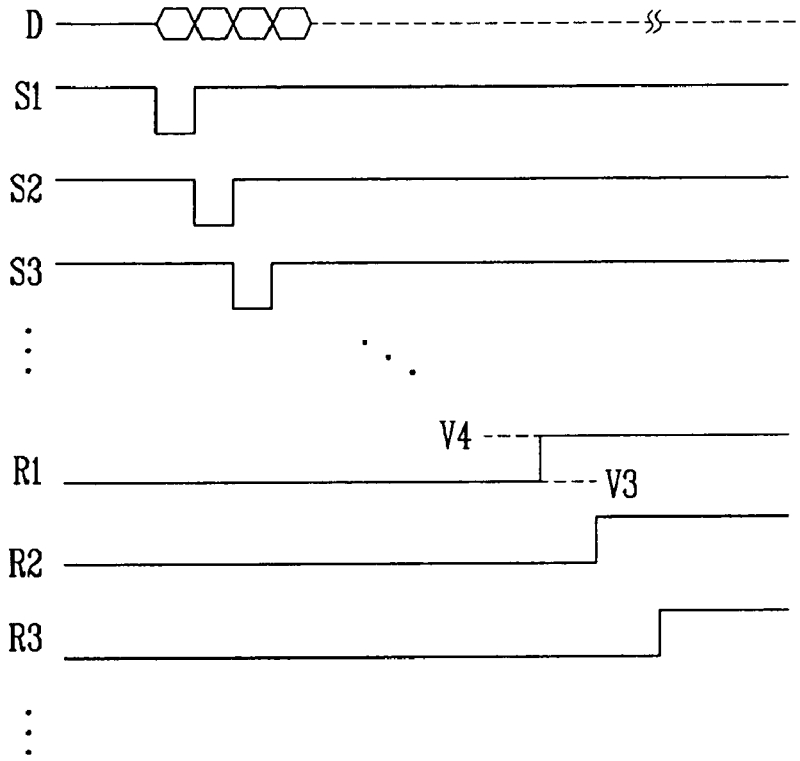
FIG. 4 is a diagram showing a driving waveform supplied during subframe periods in one frame.

FIG. 3 is a diagram showing one frame. FIG. 4 is a waveform view showing a driving waveform supplied during a subframe period.

Referring to FIG. 3 and FIG. 4, one frame (1F) according to the present invention is divided into a plurality of subframes (SF1~SF8). Here, each of the subframes (SF1~SF8) is divided into a scan period for sequentially supplying a scan signal; a light emission period for allowing pixels 40 receiving a first data signal during the scan period to emit the light; and a reset period for putting the pixels 40 into a non-light-emitted state.

A scan signal is sequentially supplied to the scan lines (S1 to Sn) during the scan period. Also, a first data signal or a second data signal is supplied to the data lines (D1 to Dm). Accordingly, the pixels 40 receive the first data signal or the second data signal during the scan period.

Each of the pixels 40 is driven to emit light or to not emit light during the light emission period according to the first data signal or the second data signal, supplied during the scan period. The pixels 40 receiving the first data signal during the light emission period is set to a light-emitting state during the corresponding subframe periods, and the pixels 40 receiving the second data signal is set to a non-light-emitting state during the corresponding subframe periods.

The light emission period is set differently in each of the subframes (SF1~SF8). For example, if an image is displayed with 256 grey levels, one frame is divided into 8 subfields (SF1 to SF8), as shown in FIG. 3. And, the light emission period is increased at a rate of $2^n$ (n=0, 1, 2, 3, 4, 5, 6, 7) in each of the 8 subfields (SF1 to SF8). Accordingly, an image having grey levels may be displayed by controlling the light emission of the pixels 40 in each of the subframes. The effective brightness of each pixel 40 during one frame period is determined according to the sum of the times of the subframes when the pixels emit light during the subframe periods.

Shown in FIG. 3 is one example where one frame may be divided into at least 10 subframes, and the light emission period in each of the subframes may be set to various periods.

A reset signal is supplied to the reset lines (R1 to Rn) during the reset period. In some embodiments, the reset signal is supplied to the pixels 40 after the pixels 40 are allowed to emit the light in each of the subframes. The pixels 40 are put into a non-light-emitted state if the reset signal is supplied to the pixels 40.

Figure 5:
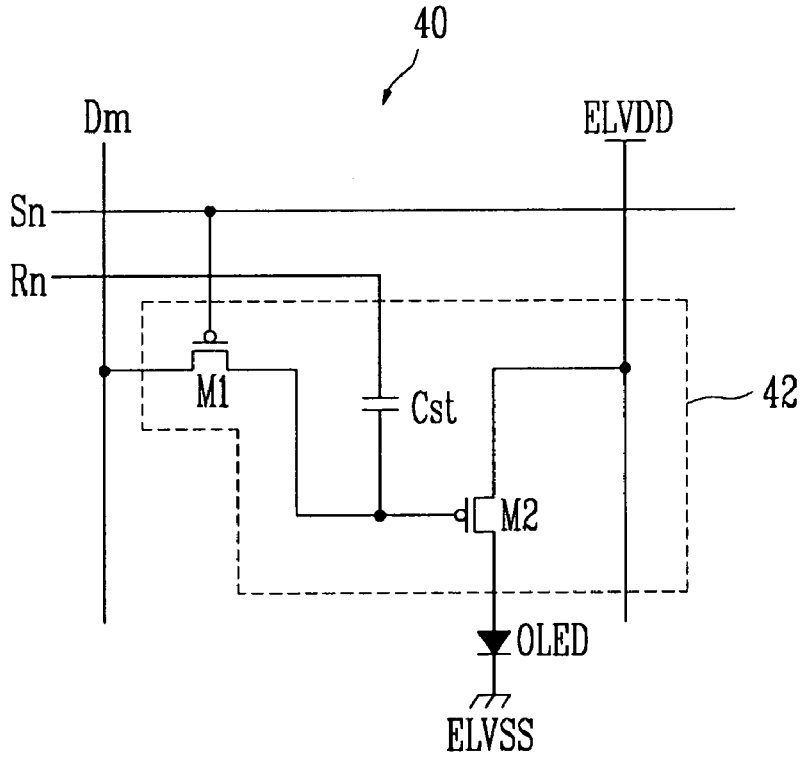
FIG. 5 is a diagram showing a pixel according to one embodiment.

FIG. 5 is a diagram showing a pixel according to one embodiment. FIG. 5 illustrates a pixel 40 connected with an $m^{th}$ scan line (Sm) and an $n^{th}$ data line (Dn).

Referring to FIG. 5, the pixel 40 includes an organic light emitting diode (OLED); a pixel circuit 42 connected to data lines (Dm), reset lines (Rn) and scan lines (Sn) to control an organic light emitting diode (OLED).

An anode electrode of the organic light emitting diode (OLED) is connected to the pixel circuit 42, and a cathode electrode is connected to a second power source (ELVSS). Such an organic light emitting diode (OLED) emits light or does not emit light according to the data signal supplied to the pixel circuit 42.

The pixel circuit 42 controls light emission or non-light emission of the organic light emitting diode (OLED) according to the data signal supplied to the data lines (Dm) when a scan signal is supplied to the scan lines (Sn). And, the pixel circuit 42 is put into a non-light-emitted state when a reset signal is supplied to the reset lines (Rn).

The pixel circuit 42 includes a first transistor (M1) connected to the data lines (Dm) and the scan lines (Sn); a second transistor (M2) connected to the second electrode of the first transistor (M1), the first power source (ELVDD) and the anode electrode of the organic light emitting diode (OLED); and a storage capacitor (Cst) connected between the gate electrode of the second transistor (M2) and the reset lines (Rn).

A gate electrode of the transistor (M1) is connected to the scan lines (Sn), and a first electrode is connected to the data lines (Dm). A second electrode of the first transistor (M1) is connected to a gate electrode of the second transistor (M2). The first transistor (M1) is turned on when a scan signal is supplied to the scan lines (Sn). A data signal concurrently supplied to the data lines (Dm), is passed to the gate electrode of the second transistor (M2).

The gate electrode of the second transistor (M2) is connected to the second electrode of the first transistor (M1), and a first electrode is connected to the first power source (ELVDD). The second electrode of the second transistor (M2) is connected to an anode electrode of the organic light emitting diode (OLED). The second transistor (M2) controls whether or not current is supplied to the organic light emitting diode (OLED) according to the voltage applied to gate electrode of the second transistor (M2).

The second transistor (M2) controls whether or not an electric current is supplied to the organic light emitting diode (OLED) according to the data signal. The second transistor (M2) does not control current amount, and supplies an electric current while being in a turned-on or off state. Accordingly, an image having a uniform luminance may be displayed in the pixel unit 30 regardless of the variation in threshold voltage of the second transistor (M2).

One terminal of the storage capacitor (Cst) is connected to the gate electrode of the second transistor (M2), and the other terminal is connected to the reset lines (Rn). A voltage of the third power source (V3) is maintained if a reset signal is not supplied to the reset lines (Rn), and a voltage of the fourth power source (V4), which is higher than the voltage of the third power source (V3), is maintained if a reset signal is supplied to the reset lines (Rn).

Hereinafter, an operation system of the pixel circuit will be described. First, the first transistor (M1) is turned on if a scan signal is supplied to the scan lines (Sn). A first data signal (for example, a logic of "0": a low voltage (for example, an ELVSS voltage)) or a second data signal (for example, a logic of "1": a high voltage (for example, an ELVDD voltage)) is supplied to the data lines (Dm) while the first transistor (M1) is turned on.

The storage capacitor (Cst) charges a voltage corresponding to the difference between the voltage of the third power source (V3), supplied to the reset lines (Rn), and the data signal. Here, a voltage value of the third power source (V3) is set to a voltage that can turn on the second transistor (M2) when the first data signal is supplied thereto. After a voltage corresponding to the data signal is charged in the storage capacitor (Cst), the second transistor (M2) controls whether or not an electric current is supplied from the first power source (ELVDD) to the second power source (ELVSS) through the organic light emitting diode (OLED). The second transistor (M2) is turned on or turned off according to the voltage charged in the storage capacitor (Cst).

Then, a reset signal is supplied to the reset lines (Rn). When the reset signal is supplied to the reset lines (Rn), a voltage of the Rn terminal of the storage capacitor (Cst) increases from the voltage of the third power source (V3) to the voltage of the fourth power source (V4). In response, the voltage of the gate electrode of the second transistor (M2) is also increased. In this case, the second transistor (M2) is put into a turned-off state regardless of the voltage charged in the storage capacitor (Cst). For this purpose, the voltage of the fourth power source (V4) is set to a voltage that can turn off the second transistor (M2) regardless of the voltage charged in the storage capacitor (Cst).

As described above, the light emission or the non-light emission of the pixels 40 is controlled by the voltage supplied to the Rn terminal of the storage capacitor (Cst) without adding a transistor for controlling light emission or non-light emission. Accordingly, a configuration of the pixels 40 may be simplified, and easily applied to a system with a digital driving mode. The digital driving mode is generally described in the description of the pixel 40 as shown in FIG. 5, and the pixel 40 may also be applied to an analog driving mode.

Meanwhile, a white balance of pixels may be controlled by employing a supply time point of the reset signal supplied to the reset lines (Rn).

Generally, the pixels are divided into red pixels including a red organic light emitting diode; green pixels including a green organic light emitting diode; and blue pixels including a blue organic light emitting diode. Here, the red organic light emitting diode, the green organic light emitting diode and the blue organic light emitting diode have different life spans since they are formed of different materials. The blue organic light emitting diode generally has the shortest life span and the green organic light emitting diode generally has the longest life span. Accordingly, after the organic light emitting display device is driven for a period of time, white balance is affected due to the difference in ageing of the organic light emitting diodes, resulting in deterioration in display quality.

In some embodiments, white balance-related problem may be solved by using a reset signal to control light emission times of the red pixels, the green pixels and the blue pixels. For example, the time of the reset signal may be adjusted so that the blue pixels can be set to have the shortest light emission period and the green pixels can be set to have the longest light emission period during each of the subframe periods, respectively. Then, an image having a proper white balance may be displayed regardless of the driving time of the organic light emitting display.

Figure 6:
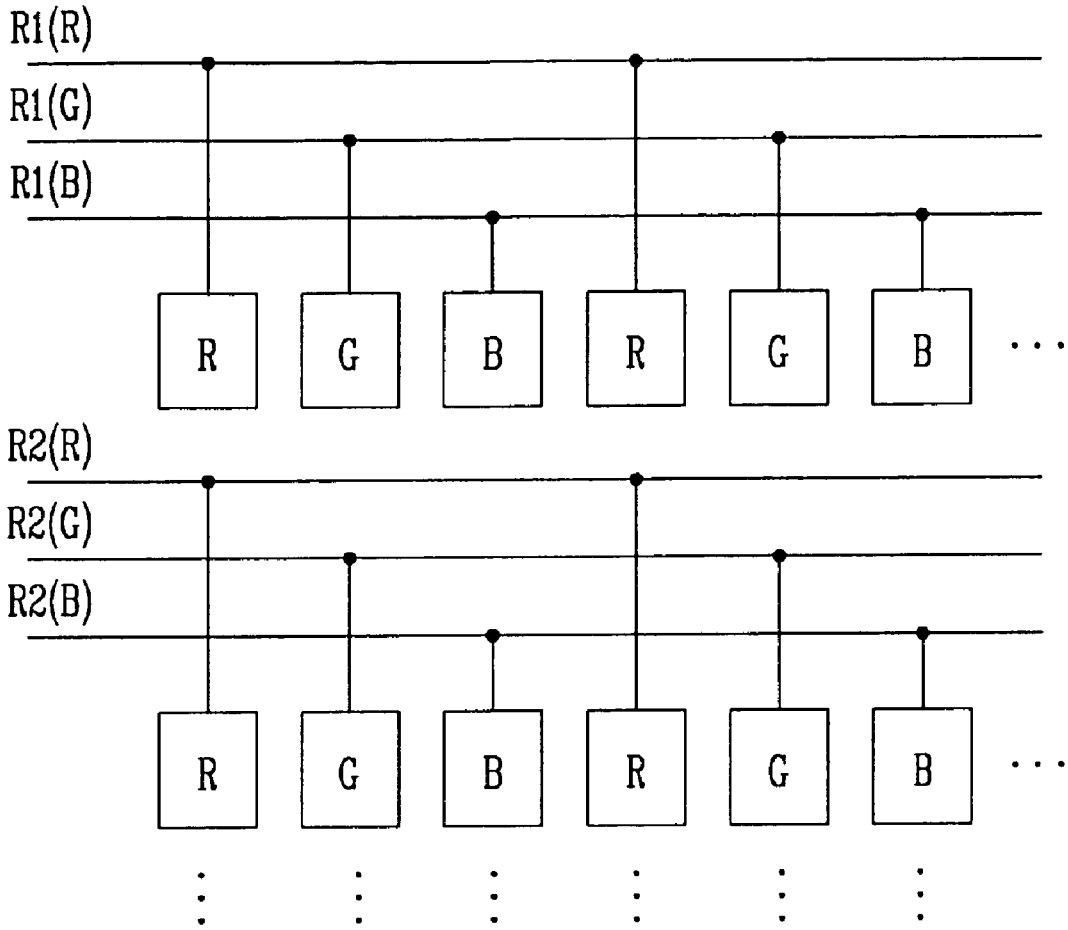
FIG. 6 is an embodiment showing connections of reset lines if red pixels, green pixels and blue pixels arranged in one horizontal line.

For this purpose, three reset lines (R) may be formed in one horizontal line, as shown in FIG. 6. Here, the reset lines formed in one horizontal line are divided into red reset lines (R (R)) connected with the red pixels; green reset lines (R (G)) connected with the green pixels; and blue reset lines (R (B)) connected with the blue pixels.

Figure 7:
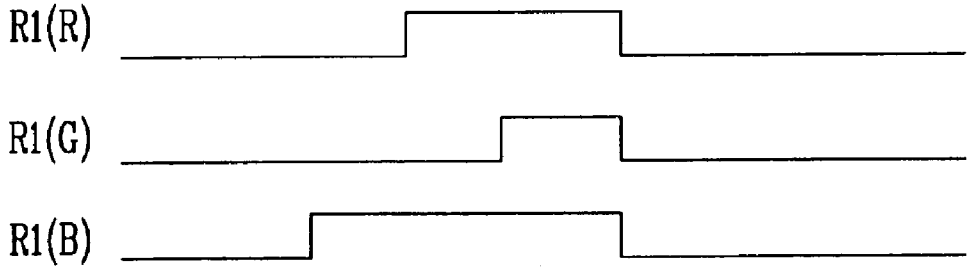
FIG. 7 is a diagram showing a reset signal supplied to the reset line shown in FIG. 6.

In some embodiments, a reset signal is supplied to the blue reset lines (R (B)) for the longest time, and a reset signal is supplied to the green reset lines (R (G) for the shorted time in the same horizontal line, as shown in FIG. 7. Then, the blue pixels (B) are allowed to emit the light for the shortest time, and the green pixels (G) are allowed to emit the light for the longest time. Therefore, it is possible to solve a white balance problem.

Figure 8:
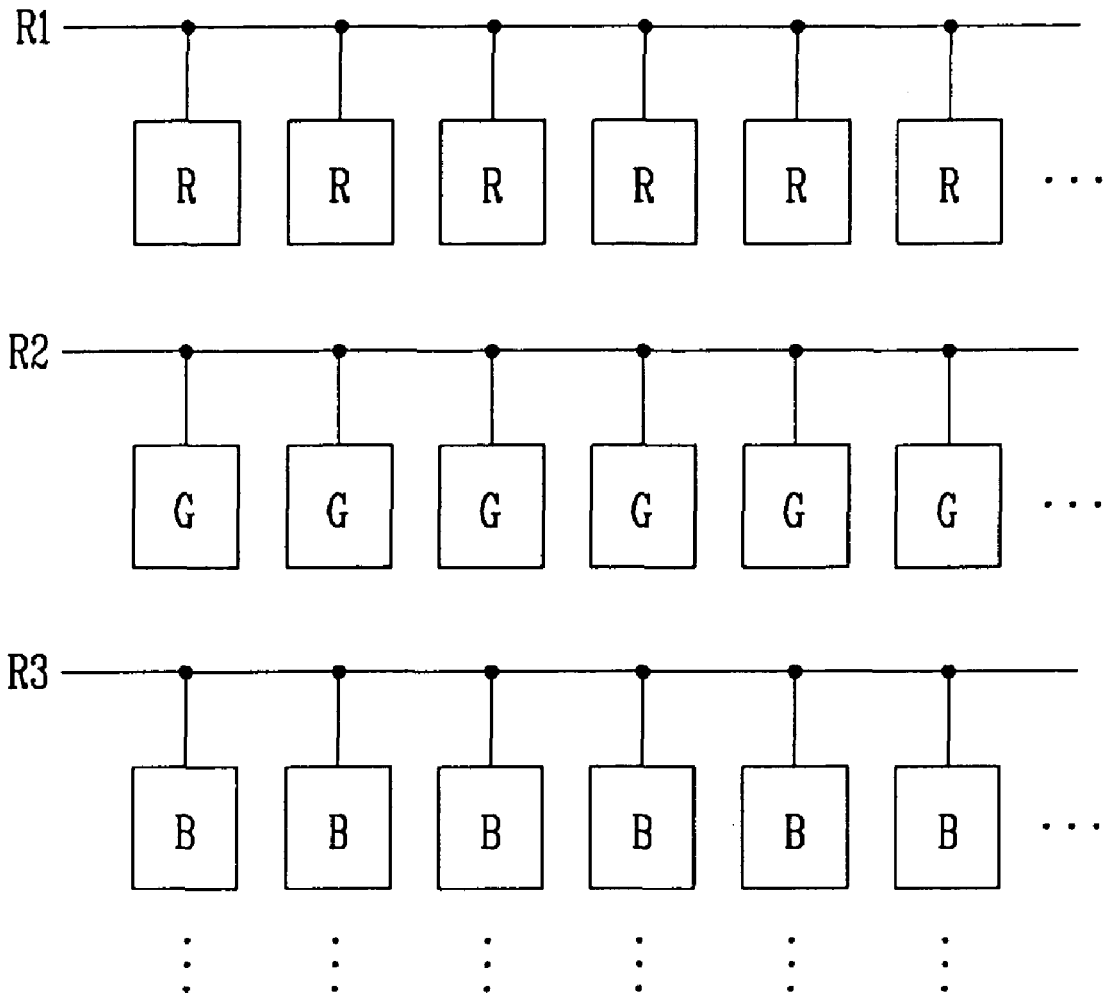
FIG. 8 illustrates an embodiment showing connections of reset lines of pixels having one color arranged in a horizontal line.

FIG. 6 illustrates that red pixels (R), green pixels (G) and blue pixels (B) are sequentially arranged in one horizontal line. The pixels may be arranged in one horizontal line for each color, as shown in FIG. 8. In this case, only one reset line (R) is arranged in one horizontal line, and it is possible to solve the white balance problem while controlling a reset signal supplied to the reset lines (R). That is to say, an image having a proper white balance may be displayed by controlling the light emission times of the red pixels, the green pixels and the blue pixels in consideration of the life span characteristics during the subframe periods.

As described above, according to the pixels according to the described embodiments, and the organic light emitting display using the same, the light emission or the non-light emission of the pixels may be controlled by controlling a reset signal supplied to a terminal of the storage capacitor in each of the pixels. As a result, an additional transistor is not required for controlling light emission or non-light emission of pixels, and therefore the pixel circuit may be simplified. Also, an image having a proper white balance may be displayed by employing a reset signal according to ageing of the organic light emitting diodes.

Although embodiments of the present invention have been shown and described, it would be appreciated by those skilled in the art that changes might be made in these embodiments without departing from the principles and spirit of the invention.

What is claimed is:

1. An organic light emitting display, comprising:

a scan driver configured to sequentially supply a scan signal to a plurality of scan lines during a plurality of subframe periods during one frame and to supply a reset signal to a plurality of reset lines;

a data driver configured to apply data signals to a plurality of data lines such that the data signal is synchronized with the scan signal;

a plurality of pixels configured to emit red light each connected to the scan lines and the reset lines;

a plurality of pixels configured to emit green light each connected to the scan lines and the reset lines; and a plurality of pixels configured to emit blue light each connected to the scan lines and the reset lines;

wherein the scan driver is configured to control the duration of light emission periods, and the duration of the emission period for each of the pixels is based on the color of the light emitted by the pixel, and wherein each of the pixels comprises:

an organic light emitting diode, a first transistor having a gate electrode connected to a scan line and a first electrode connected to a data line, the first transistor configured to be turned on when a scan signal is supplied to the scan line, a second transistor having a gate electrode connected to a second electrode of the first transistor, a first electrode connected to a first power source and a second electrode connected to the organic light emitting diode, the second transistor configured to control an electric current flowing from the first power source to a second power source through the organic light emitting diode according to a data voltage from the data line, and a storage capacitor having one terminal connected to the second electrode of the first transistor and the gate electrode of the second transistor, and another terminal connected to a reset line, wherein if a reset signal is supplied to the reset line, the storage capacitor couples the reset signal to the second transistor, and in response to the coupled reset signal, the second transistor is turned off.

2. The organic light emitting display according to claim 1, wherein the scan driver is configured to control the duration of reset signal periods, and the duration of the reset signal period for each of the pixels is based on the color of the light emitted by the pixel.

3. The organic light emitting display according to claim 1, wherein durations of the light emission periods of the pixels correspond to the durations of the reset periods of the pixels.

4. The organic light emitting display according to claim 3, wherein the sums of the duration of the light emission period and the duration of the reset period of each of the pixels is substantially the same.

5. The organic light emitting display according to claim 1, wherein the duration of the light emission period of the blue pixels is the shortest period, and the duration of the light emission period of the green pixels is the longest period.

6. The organic light emitting display according to claim 1, wherein the duration of the light emission period of each of the pixels is based on an expected lifetime of the pixels.

7. The organic light emitting display according to claim 1, wherein the reset signal is capacitively coupled to each of the pixels.

8. The organic light emitting display according to claim 1, wherein the storage capacitor is configured to store a data signal which controls the light emission of the pixel.

9. An organic light emitting display, comprising:

a scan driver configured to sequentially supply a scan signal to a plurality of scan lines during a plurality of subframe periods during one frame and to supply a reset signal to a plurality of reset lines;

a data driver configured to apply data signals to a plurality of data lines such that the data signal is synchronized with the scan signal;

a plurality of pixels configured to emit red light each connected to the scan lines and the reset lines;

a plurality of pixels configured to emit green light each connected to the scan lines and the reset lines; and a plurality of pixels configured to emit blue light each connected to the scan lines and the reset lines;

wherein the scan driver is configured to control the duration of light emission periods, and the duration of the emission period for each of the pixels is based on the color of the light emitted by the pixel, and wherein each of the pixels comprises:

an organic light emitting diode, a transistor, configured to control an electric current flowing through the organic light emitting diode according to a data voltage, and a storage capacitor having one terminal connected to the transistor, and another terminal connected to a reset line, wherein if a reset signal is supplied to the reset line, the storage capacitor couples the reset signal to the transistor, and in response to the coupled reset signal, the transistor is turned off.

10. The organic light emitting display according to claim 9, wherein the scan driver is configured to control the duration of reset signal periods, and the duration of the reset signal period for each of the pixels is based on the color of the light emitted by the pixel.

11. The organic light emitting display according to claim 9, wherein durations of the light emission periods of the pixels correspond to the durations of the reset periods of the pixels.

12. The organic light emitting display according to claim 11, wherein the sums of the duration of the light emission period and the duration of the reset period of each of the pixels is substantially the same.

13. The organic light emitting display according to claim 9, wherein the duration of the light emission period of the blue pixels is the shortest period, and the duration of the light emission period of the green pixels is the longest period.

14. The organic light emitting display according to claim 9, wherein the duration of the light emission period of each of the pixels is based on an expected lifetime of the pixels.

15. The organic light emitting display according to claim 9, wherein the reset signal is capacitively coupled to each of the pixels.

16. An organic light emitting display, comprising:

a scan driver configured to sequentially supply a scan signal to a plurality of scan lines during a plurality of subframe periods during one frame and to supply a reset signal to a plurality of reset lines;

a data driver configured to apply data signals to a plurality of data lines such that the data signal is synchronized with the scan signal;

a first plurality of pixels configured to emit light of a first color, each first pixel connected to the scan lines and the reset lines; and a second plurality of pixels configured to emit light of a second color, each second pixel connected to the scan lines and the reset lines, wherein the scan driver is configured to control the duration of light emission periods, and the duration of the emission period for each of the pixels is based on the color of the light emitted by the pixel, and wherein each of the pixels comprises:

an organic light emitting diode, a transistor, configured to control an electric current flowing through the organic light emitting diode according to a data voltage, and a storage capacitor having one terminal connected to the transistor, and another terminal connected to a reset line, wherein if a reset signal is supplied to the reset line, the storage capacitor couples the reset signal to the transistor, and in response to the coupled reset signal, the transistor is turned off.

17. The organic light emitting display according to claim 16, wherein the scan driver is configured to control the duration of reset signal periods, and the duration of the reset signal period for each of the pixels is based on the color of the light emitted by the pixel.

18. The organic light emitting display according to claim 16, wherein durations of the light emission periods of the pixels correspond to the durations of the reset periods of the pixels.

19. The organic light emitting display according to claim 18, wherein the sums of the duration of the light emission period and the duration of the reset period of each of the pixels is substantially the same.

20. The organic light emitting display according to claim 16, wherein the duration of the light emission period of the blue pixels is the shortest period, and the duration of the light emission period of the green pixels is the longest period.

21. The organic light emitting display according to claim 16, wherein the duration of the light emission period of each of the pixels is based on an expected lifetime of the pixels.

22. The organic light emitting display according to claim 16, wherein the reset signal is capacitively coupled to each of the pixels.

* * * * *